US011585357B1

(12) United States Patent
Chen et al.

(10) Patent No.: US 11,585,357 B1
(45) Date of Patent: Feb. 21, 2023

(54) SHOCK ABSORBING FAN CASING

(71) Applicant: Yen Sun Technology Corp., Kaohsiung (TW)

(72) Inventors: Graham Chen, Kaohsiung (TW); Chih-Tsung Hsu, Kaohsiung (TW); Hsin-Hsien Wu, Kaohsiung (TW); Chin-Hui Pan, Kaohsiung (TW); Yu-Ting Liu, Kaohsiung (TW)

(73) Assignee: YEN SUN TECHNOLOGY CORP., Kaohsiung (TW)

( * ) Notice: Subject to any disclaimer, the term of this patent is extended or adjusted under 35 U.S.C. 154(b) by 0 days.

(21) Appl. No.: 17/850,134

(22) Filed: Jun. 27, 2022

(30) Foreign Application Priority Data

Dec. 27, 2021 (TW) ..... 110148900

(51) Int. Cl.
*F04D 29/66* (2006.01)
*F04D 25/06* (2006.01)
*F04D 19/00* (2006.01)
*F04D 29/52* (2006.01)

(52) U.S. Cl.
CPC ..... *F04D 29/668* (2013.01); *F04D 19/002* (2013.01); *F04D 25/0693* (2013.01); *F04D 29/522* (2013.01)

(58) Field of Classification Search
CPC .... F04D 29/668; F04D 29/522; F04D 19/002; F04D 25/0693
See application file for complete search history.

(56) References Cited

U.S. PATENT DOCUMENTS 5,582,507 A * 12/1996 Alizadeh ..... F04D 29/329 416/169 R
6,525,938 B1 * 2/2003 Chen ..... F04D 25/066 310/91
7,140,837 B2 * 11/2006 Ku ..... H05K 7/20172 415/214.1
7,255,529 B2 * 8/2007 Ku ..... H05K 7/20172 415/214.1
7,495,921 B2 * 2/2009 Chang ..... H01L 23/467 361/719
7,885,065 B2 * 2/2011 Kaneko ..... H02K 5/24 361/679.48

(Continued)

FOREIGN PATENT DOCUMENTS

DE 19907910 A1 * 9/2000 ..... F04D 29/283
DE 102004034472 A1 * 2/2006 ..... F04D 29/668

*Primary Examiner* — David E Sosnowski
*Assistant Examiner* — Wayne A Lambert
(74) *Attorney, Agent, or Firm* — Muncy, Geissler, Olds & Lowe, P.C.

(57) ABSTRACT

A fan casing for mounting of a fan includes a frame including four corner segments and four side segments that are arranged alternately with the corner segments, a seat disposed in the frame, and four support members extending radially and outwardly from the seat and connected respectively to the corner segments. Each support member includes a base connected to the seat and having a width reducing in a direction away from the seat, and a rib connected between the base and the corresponding corner segment. The bases are interconnected to surround the seat. Any two adjacent bases are interconnected to form an arc surface facing the corresponding side segment and adapted to absorb shock.

7 Claims, 4 Drawing Sheets

(56) References Cited

U.S. PATENT DOCUMENTS

| | | | | |
|---|---|---|---|---|
| 8,206,104 | B2 * | 6/2012 | Horng | F04D 25/0613 415/220 |
| 10,436,205 | B2 * | 10/2019 | Hamano | F04D 29/646 |
| 10,738,796 | B2 * | 8/2020 | Horng | F04D 19/002 |
| 2005/0042088 | A1 * | 2/2005 | Horski | F04D 29/522 415/213.1 |
| 2008/0170935 | A1 * | 7/2008 | Nakamura | F04D 25/064 310/90 |
| 2008/0175705 | A1 * | 7/2008 | Liu | F04D 29/601 415/119 |
| 2010/0074746 | A1 * | 3/2010 | Huang | F04D 29/601 415/220 |
| 2010/0243218 | A1 * | 9/2010 | Horng | F04D 29/646 165/121 |
| 2011/0150639 | A1 * | 6/2011 | Chen | F04D 29/328 415/182.1 |
| 2019/0162462 | A1 * | 5/2019 | Kim | F04D 29/668 |

* cited by examiner

SHOCK ABSORBING FAN CASING

CROSS-REFERENCE TO RELATED APPLICATION

This application claims priority to Taiwanese Invention Patent Application No. 110148900 filed on Dec. 27, 2021.

FIELD

The disclosure relates to a casing, more particularly to a fan casing for mounting of a heat dissipating fan.

BACKGROUND

A heat-dissipating fan is usually disposed in a computer, an electronic apparatus, or a mechanical equipment, and generates an airflow through rotation of fan blades of the heat-dissipating fan, thus achieving the effect of heat dissipation. Generally, a heat-dissipating fan includes fan blades and a motor mounted on a fan casing. Referring to FIG. 1, a conventional fan casing 1 is mounted on a mounting surface (not shown) and includes an outer frame 11 surrounding and defining a mounting space 111, an inner seat 12 disposed in the mounting space 111, and four support members 13 extending respectively from four angularly equidistant connecting points of an outer peripheral surface of the inner seat 12 toward the outer frame 11 in directions tangential to the outer peripheral surface. The outer frame 11 includes four corner segments 112 angularly spaced apart from one another, and four side segments 113 disposed alternately with the corner segments 112. Two ends of each of the side segments 113 are respectively connected to adjacent two of the corner segments 112. Each of the corner segments 112 is formed with an opening 114 through which a screw (not shown) extends so as to fasten the conventional fan casing on the mounting surface. Each of the support members 13 has two ends connected respectively to the inner seat 12 and the corresponding side segment 113.

Since the support members 13 are connected to the side segments 113, when the fan blades are rotating, vibration generated thereby first propagates along the support members 13 to the side segments 113, and then propagates to the corner segments 112 and to the mounting surface through the screws extending through the openings 114 of the corner segments 112 and the mounting surface. Since a propagation path of the vibration is relatively long and travels all over the outer frame 11, the vibration of the fan casing 1 is relatively large.

SUMMARY

Therefore, an object of the disclosure is to provide a shock-absorbing fan casing capable of absorbing shock generated during rotation of a fan.

According to an aspect of the disclosure, a shock-absorbing fan casing for mounting of a fan is provided. The shock-absorbing fan casing includes an outer frame, an inner seat, and four support members. The outer frame surrounds and defines a mounting space and includes four corner segments equiangularly spaced apart from one another, and four side segments arranged alternately with the corner segments. Two ends of each of the side segments are respectively connected to adjacent two of the corner segments. The inner seat is disposed in the mounting space. The support members extend radially and outwardly from the inner seat and are connected respectively to the corner segments. Each of the support members includes a base portion that is connected to the inner seat and that has a width reducing gradually in a direction away from the inner seat, and a rib portion that extends radially and outwardly from an end of the base portion distal from the inner seat and that is connected to a corresponding one of the corner segments. The base portions of the support members are connected to one another to surround the inner seat. Any two adjacent ones of the base portions are connected to each other so as to form an arc surface that faces a corresponding one of the side segments of the outer frame and that is adapted to absorb shock when the fan is operating.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
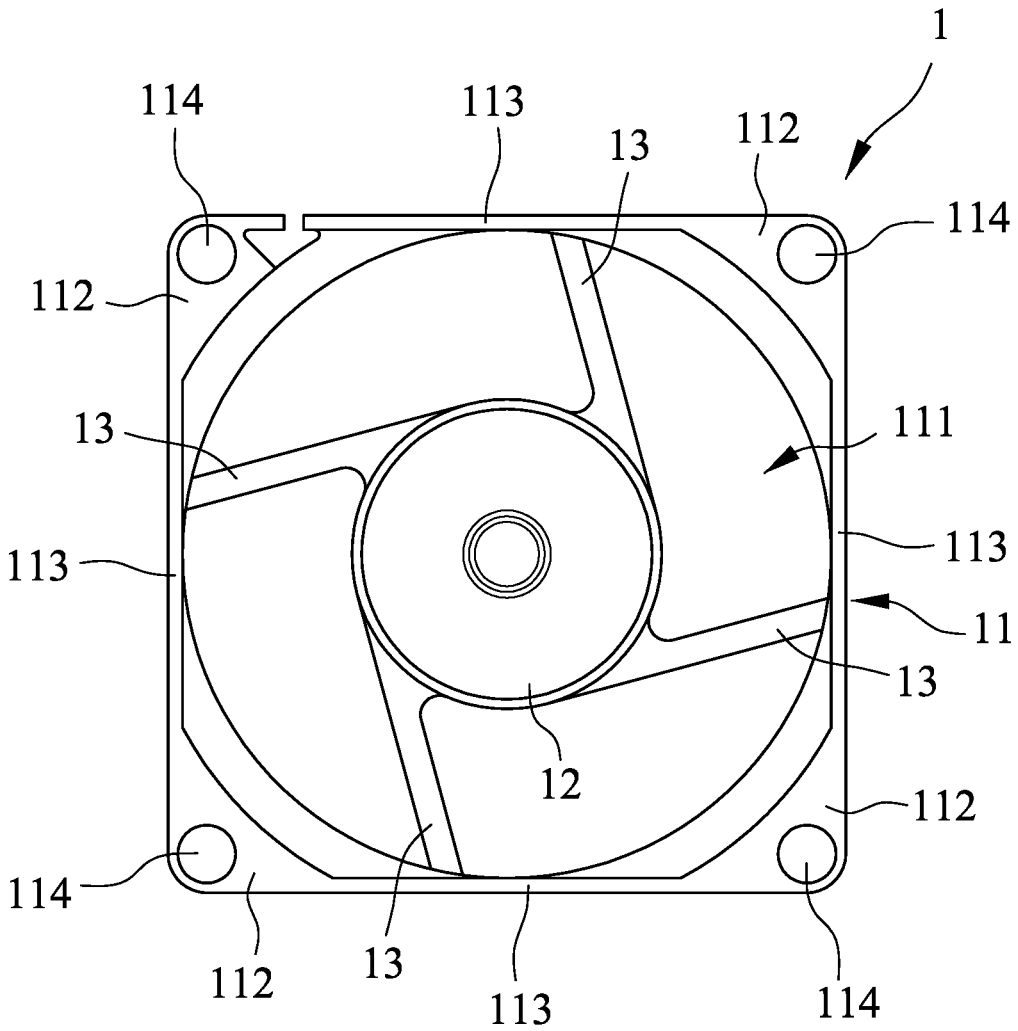
FIG.1 PRIOR ART
FIG. 1 is a schematic top view of a conventional fan casing.
Figure 2:
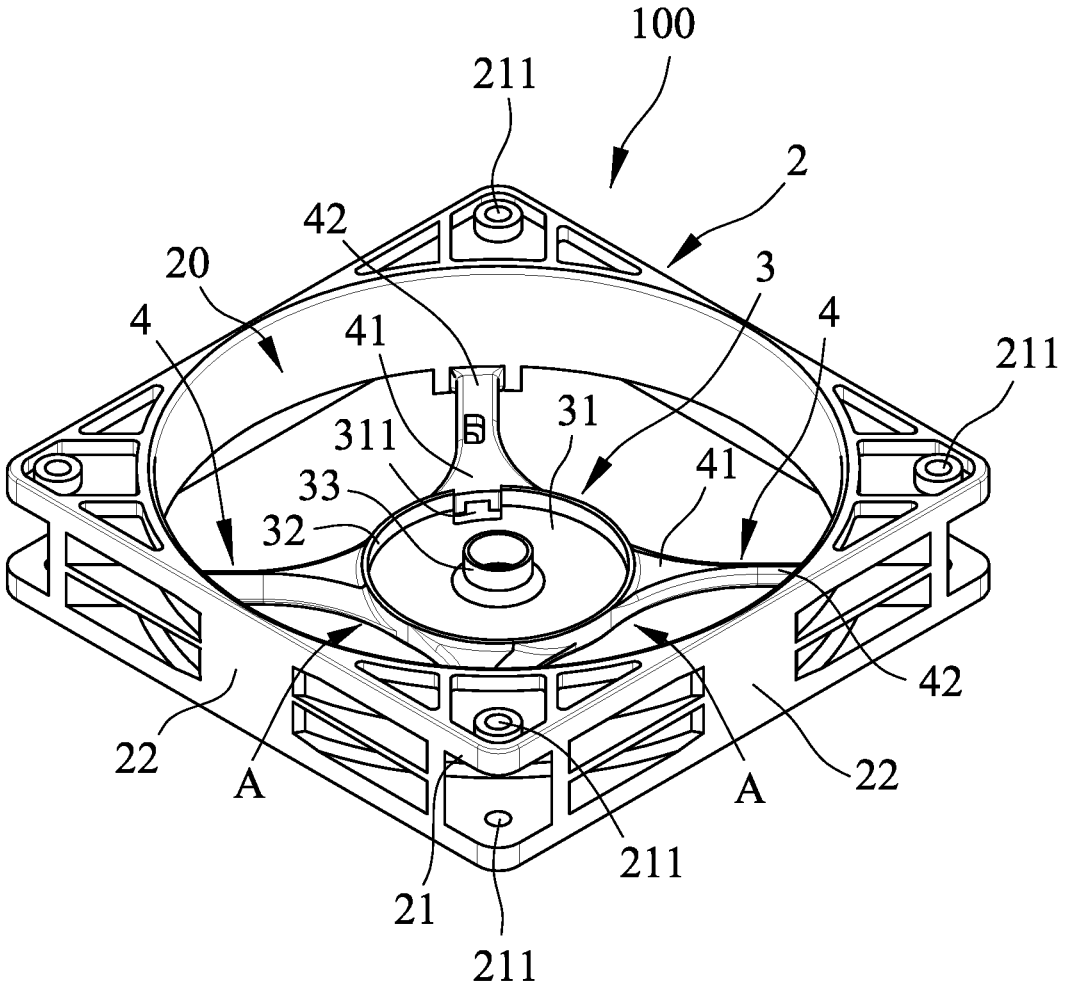
FIG. 2 is a perspective view of an embodiment of a shock-absorbing fan casing according to the present disclosure.
Figure 3:
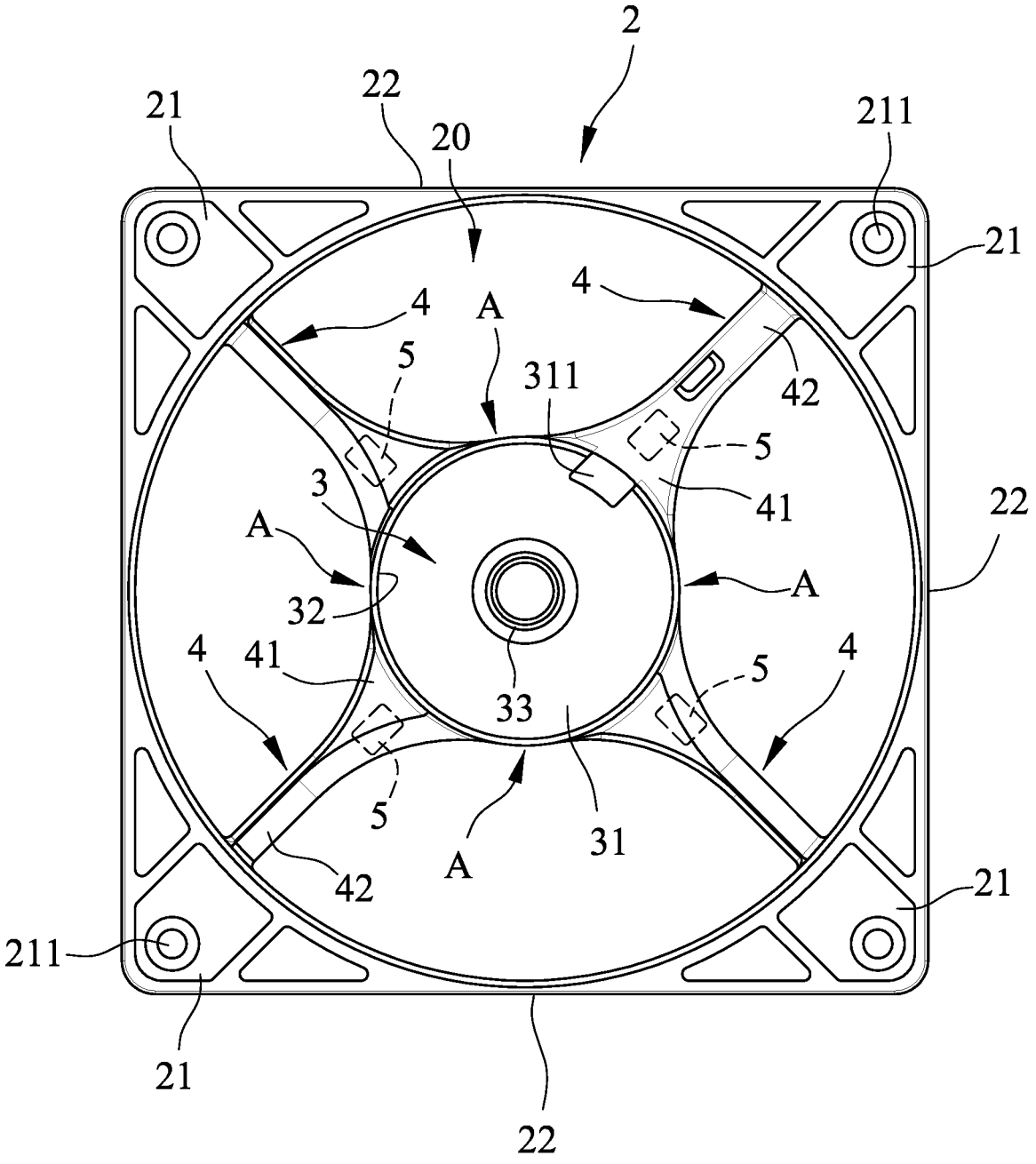
FIG. 3 is a schematic top view illustrating the embodiment.
Figure 4:
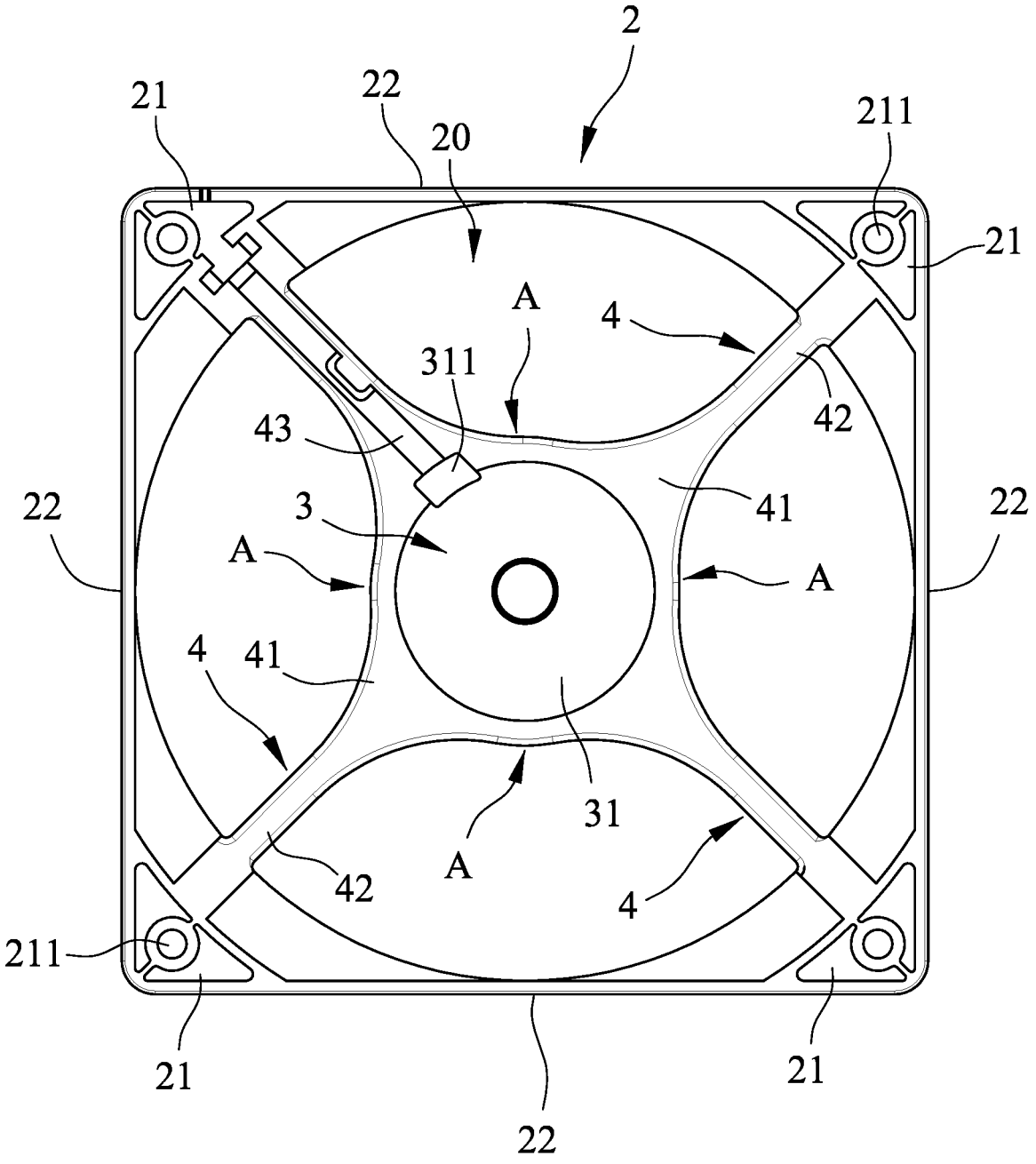
FIG. 4 is a schematic bottom view illustrating the embodiment.

Referring to FIGS. 2 to 4, an embodiment of a shock-absorbing fan casing 100 for mounting of a fan according to the present disclosure includes an outer frame 2 surrounding and defining a mounting space 20, an inner seat 3 disposed in the mounting space 20, four support members 4 extending radially and outwardly from the inner seat 3 and connected respectively to the outer frame 2, and four embedded members 5 embedded respectively in the support members 4. The outer frame 2 includes four corner segments 21 equiangularly spaced apart from one another, and four side segments 22 arranged alternately with the corner segments 21. In this embodiment, the outer frame 2 is substantially a square. The corner segments 21 are located at four corners of the square. Each of the corner segments 21 is formed with two through holes 211 spaced apart from each other along a thickness direction of the outer frame 2. For each of the corner segments 21, one of the through holes 211 has a central line coinciding with that of the other one of the through holes 211. The central lines of the through holes 211 of each of the corner segments 21 are parallel to a central axis of the inner seat 3. The through holes 211 of each of the corner segments 21 are adapted to permit a fastening member such as a screw (not shown) to extend therethrough, so that the outer frame 2 is fastened to a mounting surface (not shown). Two ends of each of the side segments 22 are respectively connected to adjacent two of the corner segments 21.

The inner seat 3 includes an annular seat portion 31 located at a central portion of the mounting space of the outer frame 2, a surrounding wall 32 extending upwardly from an outer periphery of the annular seat portion 31, and an inner wall 33 extending upwardly from an inner periphery of the annular seat portion 31 that is concentric with and surrounded by the surrounding wall 31. The inner wall 33 is provided for the fan to be mounted thereon. The annular seat portion 31 of the inner seat 3 is formed with a cable hole 311 extending along an axial direction (i.e., the thickness direction of the outer frame 2). The support members 4 are arranged to form an X-shape, i.e., any two of the support members 4 that are not adjacent to each other are aligned with each other. Each of the support members 4 is connected to a respective one of the corner segments 21 located respectively at four corners of the outer frame 2. Each of support members 4 includes a base portion 41 that is connected to the surrounding wall 32 of the inner seat 3 and that has a width reducing gradually in a direction away from the inner seat 3, and a rib portion 42 that extends radially and outwardly from an end of the base portion 41 distal from the inner seat 3 and that is connected to a corresponding one of the corner segments 21. The rib portion 42 of each of the support members 4 is oriented toward the through holes 211 of a corresponding one of the corner segments 21. The base portions 41 of the support members 4 are connected to one another to surround the surrounding wall 32 of the inner seat 3. Any two adjacent ones of the base portions 41 are connected to each other so as to form an arc surface (A) facing a corresponding one of the side segments 22 of the outer frame 2 and adapted to absorb shock when the fan is operating. Furthermore, one of the support members 4 is formed with a cable slot 43 that extends through the base portion 41 and into the rib portion 42, that is in spatial communication with the cable hole 311, and that is adapted to permit an electric cable (not shown), which is adapted for supplying electricity to the fan, to extend therethrough. In a case that a stator of the fan is disposed on the inner seat 3, an electric cable connected to the stator extends through the cable hole 311, and then extends outwardly of the one of the support members 4 through the cable slot 43. Each of the embedded members 5 is embedded in either the base portion 41 or the rib portion 42 of the corresponding one of the support members 4 to be configured as a counterweight of the support member 4, to increase the total weight of the support member 4, and to enhance the structural strength of the support member 4, and is adapted to absorb shock when the fan is operating. Thus, an effect of reducing vibration can be achieved. Note that each of the embedded members 5 may extend from the base portion 41 into the rib portion 42 of the corresponding one of the support members 4, and the configuration of the embedded members 5 is not limited to the examples described herein. In this embodiment, the embedded members 5 are made of rubber or other materials that have relatively good shock absorbing characteristics.

Since the support members 4 are connected directly and respectively to the corner segments 21 formed with the through holes 211, vibration of the inner seat 3 resulting from rotation of blades of the fan propagates directly and respectively to the corner segments 21 through the support members 4, and then propagates to the mounting surface through the screws extending respectively through the through holes 211. Thus, in the present disclosure, a propagation path of vibration would not pass by the side segments 22 and the vibration can be smoothly and quickly buffered and absorbed. The structure of the arc surface (A) formed between any two adjacent ones of the base portions 41 connected to and surrounding the surrounding wall 32 further provides a shock absorbing effect when the fan is operating. The embedded members 5 increase the weights of the support members 4 to reduce a degree of vibration thereof, and is made of shock absorbing material to provide a relatively good shock absorbing effect.

In summary, by virtue of the configuration of the support members 4 that are arranged in an X-shape and that do not extend in directions tangential to an outer peripheral surface of the annular seat portion 31, and the arc surfaces (A) that are formed by the base portions 41 connected to and surrounding the inner seat 3 to absorb shock, the present disclosure provides a relatively good shock absorbing effect. Thus, the object of this disclosure is indeed achieved.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A shock-absorbing fan casing for mounting of a fan, comprising:

an outer frame surrounding and defining a mounting space, said outer frame including four corner segments equiangularly spaced apart from one another, and four side segments arranged alternately with said corner segments, two ends of each of said side segments being respectively connected to adjacent two of said corner segments;

an inner seat disposed in said mounting space; and four support members extending radially and outwardly from said inner seat and connected respectively to said corner segments, each of said support members including a base portion that is connected to said inner seat and that has a width reducing gradually in a direction away from said inner seat, and a rib portion that extends radially and outwardly from an end of said base portion distal from said inner seat and that is connected to a corresponding one of said corner segments, said base portions of said support members being connected to one another to surround said inner seat, any two adjacent ones of said base portions being connected to each other so as to form an arc surface facing a corresponding one of said side segments of said outer frame and adapted to absorb shock when the fan is operating.

2. The shock-absorbing fan casing as claimed in claim 1, wherein four embedded members embedded respectively in said support members and adapted to absorb shock when the fan is operating.

3. The shock-absorbing fan casing as claimed in claim 1, wherein any two of said support members that are not adjacent to each other are aligned with each other.

4. The shock-absorbing fan casing as claimed in claim 1, wherein each of said corner segments of said outer frame is formed with at least one through hole adapted to permit a fastening member to extend therethrough, so that said outer frame is fastened to a mounting surface, said rib portion of each of said support members being oriented toward said at least one through hole of a corresponding one of said corner segments.

5. The shock-absorbing fan casing as claimed in claim 4, wherein said through hole of each of said corner segments has a central line parallel to a central axis of said inner seat.

6. The shock-absorbing fan casing as claimed in claim 1, wherein said inner seat is formed with a cable hole, one of said support members being formed with a cable slot that extends through said base portion and into said rib portion, that is in spatial communication with said cable hole, and that is adapted to permit an electric cable, which is adapted for supplying electricity to the fan, to extend therethrough.

7. The shock-absorbing fan casing as claimed in claim 1, wherein said inner seat includes an annular seat portion, a surrounding wall extending upwardly from an outer periphery of said seat portion and connected to said base portions, and an inner wall extending upwardly from an inner periphery of said seat portion that is concentric with and surrounded by said surrounding wall.

* * * * *